US007811082B2

(12) United States Patent
Czajka et al.

(10) Patent No.: US 7,811,082 B2
(45) Date of Patent: Oct. 12, 2010

(54) GAS CIRCUIT AND PILOT LIGHT SYSTEM FOR COOKING RANGE

(75) Inventors: Charles Czajka, Forest Hill, MD (US); Philip Joseph Pio Vincenty, Ellicott City, MD (US); Randall B. Diggins, Baltimore, MD (US)

(73) Assignee: Premark FEG, LLC, Wilmington, DE (US)

( * ) Notice: Subject to any disclaimer, the term of this patent is extended or adjusted under 35 U.S.C. 154(b) by 353 days.

(21) Appl. No.: 11/030,617

(22) Filed: Jan. 5, 2005

(65) Prior Publication Data

US 2006/0147861 A1 Jul. 6, 2006

(51) Int. Cl.
*F23Q 9/00* (2006.01)

(52) U.S. Cl. ..... 431/278; 431/266; 431/343; 431/354; 126/39 H; 126/39 N; 126/39 G; 137/883

(58) Field of Classification Search ..... 431/278, 431/280, 153, 354, 343, 266, 264, 355, 259, 431/263; 126/39 N, 39 E, 42, 19 R, 273 R, 126/39 G, 39 H; 137/883, 74; 131/278, 131/280; 251/208
See application file for complete search history.

(56) References Cited

U.S. PATENT DOCUMENTS

| | | | | | |
|---|---|---|---|---|---|
| 478,295 | A | | 7/1892 | Squire et al. | |
| 1,012,054 | A | | 12/1911 | Berry | |
| 1,085,671 | A | | 2/1914 | Day | |
| 2,105,340 | A | | 1/1938 | Yeager | 126/38 |
| 2,164,887 | A | * | 7/1939 | Roberts et al. | 431/48 |
| 2,257,399 | A | | 9/1941 | Parker et al. | 126/39 |
| 2,320,754 | A | | 6/1943 | Sherman | 126/39 |
| 2,352,329 | A | * | 6/1944 | Koppel | 431/278 |
| 2,450,744 | A | * | 10/1948 | Whitehead | 126/39 N |
| 2,626,634 | A | * | 1/1953 | Mcdowell | 137/883 |
| 2,642,309 | A | * | 6/1953 | Wasser | 126/39 G |
| 2,691,369 | A | | 10/1954 | Rutenber | 126/332 |
| 2,705,531 | A | * | 4/1955 | Rice et al. | 431/45 |
| 2,733,758 | A | * | 2/1956 | Lundgren | 431/61 |
| 2,735,483 | A | * | 2/1956 | Brodbeck et al. | 431/16 |
| 2,766,683 | A | | 10/1956 | Kanz | 99/425 |
| 2,781,779 | A | * | 2/1957 | Kindl | 137/601.16 |
| 2,879,708 | A | | 3/1959 | Cripe | 99/342 |
| 2,939,524 | A | * | 6/1960 | Mathis et al. | 236/99 R |
| 3,538,907 | A | | 11/1970 | Bowman et al. | 126/38 |
| 3,627,462 | A | * | 12/1971 | Lotter | 431/284 |
| 3,797,375 | A | | 3/1974 | Cerola | 99/340 |
| 4,042,806 | A | | 8/1977 | McCartney | 219/447 |
| 4,045,155 | A | * | 8/1977 | Wolfe et al. | 431/42 |

(Continued)

FOREIGN PATENT DOCUMENTS

| | | |
|---|---|---|
| EP | 0 371 715 A1 | 11/1989 |

(Continued)

*Primary Examiner*—Steven B McAllister
*Assistant Examiner*—Avinash Savani
(74) *Attorney, Agent, or Firm*—Taylor IP, P.C.

(57) ABSTRACT

A gas circuit with a pilot light system for ranges includes pilot tubes from a gas manifold to burner assemblies. Quick connect couplings are provided between the pilot tubes and manifold so that the pilot tube can be removed easily. Two or more tubes can be connected to a single coupling. A master shutoff interrupts flow to the cooktop without interrupting flow to the oven.

11 Claims, 4 Drawing Sheets

U.S. PATENT DOCUMENTS

| | | | | |
|---|---|---|---|---|
| 4,088,436 | A * | 5/1978 | Alferes | 431/21 |
| 4,311,451 | A | 1/1982 | Matumoto et al. | 431/352 |
| 4,409,954 | A | 10/1983 | Berlik et al. | 126/39 |
| 4,583,941 | A | 4/1986 | Elperin et al. | 431/347 |
| 4,677,964 | A | 7/1987 | Lohmeyer et al. | 126/41 |
| 4,773,319 | A | 9/1988 | Holland | 99/446 |
| 5,145,361 | A | 9/1992 | Kurzinski | 432/19 |
| 5,336,084 | A | 8/1994 | Long | 431/354 |
| 5,456,163 | A | 10/1995 | Ceravolo | 99/446 |
| 5,713,265 | A | 2/1998 | Strader et al. | 99/446 |
| 5,787,874 | A * | 8/1998 | Krohn et al. | 126/39 BA |
| 5,873,713 | A | 2/1999 | Osterhues | 431/354 |
| D414,654 | S | 10/1999 | Epps | D7/402 |
| 5,979,430 | A * | 11/1999 | Peed et al. | 126/39 N |
| 6,092,518 | A | 7/2000 | Dane | 126/214 |
| 6,345,768 | B1 | 2/2002 | Inagaki | 236/15 |
| 6,492,622 | B2 | 12/2002 | Melson et al. | 219/412.11 |
| 6,570,135 | B2 | 5/2003 | Gros et al. | 219/396 |
| 6,619,280 | B1 | 9/2003 | Zhou | 126/39 |
| 6,688,882 | B1 * | 2/2004 | Williams | 431/354 |
| 6,843,243 | B2 * | 1/2005 | Steurer | 126/42 |

FOREIGN PATENT DOCUMENTS

| | | | |
|---|---|---|---|
| EP | 0 583 555 | A1 | 5/1993 |
| EP | 0 612 494 | A1 | 2/1994 |
| EP | 0 793 058 | A2 | 2/1997 |
| EP | 0 801 269 | A2 | 3/1997 |
| JP | 58-69328 | | 4/1983 |
| JP | 60-140025 | | 7/1985 |
| JP | 63-251726 | | 10/1988 |
| JP | 4-116319 | | 4/1992 |
| JP | 10-227418 | | 2/1997 |
| JP | 10-185205 | | 7/1998 |
| JP | 11-141814 | | 5/1999 |
| JP | 11-299652 | | 11/1999 |
| JP | 2000-304284 | | 11/2000 |
| JP | 2001-65817 | | 3/2001 |
| JP | 2000-249703 | | 10/2001 |
| TW | 41-4847 | | 12/2000 |
| WO | WO 92/04112 | | 3/1992 |
| WO | WO 97/41740 | | 11/1997 |
| WO | WO 03/096857 | A1 | 11/2003 |

* cited by examiner

GAS CIRCUIT AND PILOT LIGHT SYSTEM FOR COOKING RANGE

FIELD OF THE INVENTION

The present invention generally relates to gas-fired appliances and, more particularly, to gas supply circuits for cooking ranges and commercial cook tops having pilot lights for igniting burners.

BACKGROUND OF THE INVENTION

Gas-fired cooking ranges are used in both residential and commercial kitchens. A basic design for a gas-fired range includes a gas supply source, a manifold and one or more burner assemblies for receiving gas from the gas supply source. Burner assemblies are provided at one or more location for cooking on top of the range, and in an enclosed oven for baking. A control valve is used for each burner assembly, to initiate and terminate gas flow from the manifold to the burner assembly, and to control the gas flow to regulate the intensity of the flame at the burner assembly. When gas flow is initiated to the burner, an ignition source is required to ignite the gas flow. A known ignition system includes an open-flame, standing pilot system, which includes a continuously burning, small intensity flame adjacent the burner to ignite gas from the burner when gas flow is initiated to the burner. To reduce fuel consumption, a variety of non-standing pilot light systems have been used, including piezo electric and spark ignition systems.

Spark ignition and piezo ignition pilot systems have achieved some acceptability in residential installations. However, in commercial kitchens where ranges are used almost continuously, and hundreds of meals may be prepared in a short time, difficulties have been encountered with spark and piezo pilot systems. Each must be kept very clean to work properly. In commercial kitchens with large quantities of food being prepared in what can be a somewhat hectic environment, spills and boil-overs are common occurrences. Piezo electric and spark ignition systems can be fouled by spillage or boil-overs and thereafter may not work properly. As a result, the burners of a cook top often remain on during the entire kitchen operating time, wasting great amounts of gas. Alternatively, standing pilots are often preferred in commercial kitchens, in part due to their less vulnerability to contamination and fouling and greater reliability.

Cleanability is an important consideration for both residential and commercial ranges. Since the amount of food prepared and the environment in a commercial kitchen can result in frequent spills, and the need for more frequent thorough cleanings, the cleanability and ease of disassembly for a commercial range may be of even greater importance than for a residential range. Known standing pilot ignition systems have included a small gas tube rigidly secured to the manifold and/or to the underneath support area below the burners. Thus, the pilot lights are not removed easily, and often are left in place when the burner assemblies are removed for cleaning. Even when the grates and burners are removed, cleaning around the pilot light system can be difficult in that they are connected in place, more or less permanently. Consequently, food spilled onto and beneath the pilot light gas tubes can be difficult to clean.

Standing open-flame pilot light systems burn continuously unless gas supply to the entire range is interrupted at a main appliance shut-off valve. Although standing pilot light flames are small, when burned continuously the amount of fuel consumed can be significant. Burning pilot lights when a kitchen is closed and not in use is wasteful and expensive. However, known gas circuits for ranges including ovens have used only a single shut-off valve for the entire appliance. The shut-off is on the back of the appliance, and is difficult to access. Further, shutting off all pilot lights including the oven pilot light can be inconvenient, in that oven burner pilot lights are often difficult to re-light due their relative inconvenient location.

What is needed in the art is a shut-off system for pilot lights to reduce fuel consumption when a cook range is not in use and a pilot light system that can be removed quickly and easily for thorough cleaning of the range.

SUMMARY OF THE INVENTION

The present invention provides a gas circuit for a cooking range with pilot tubes supported on the burner assemblies, and quick connect couplings attaching the tubes to a gas manifold so that removal of the burner assemblies also leads to removal of the pilot tubes. A shut-off valve may terminate gas flow to the burners and pilot lights on the range, but not in the oven.

In one aspect thereof, the present invention provides a gas supply circuit for a gas cooktop. A gas manifold is configured for connection to a gas supply source; a burner assembly includes a venturi positioned to receive gas from an orifice in the manifold and a gas valve controls gas flow from the manifold to the venturi. A pilot gas tube is connected to the manifold through a quick connect coupling including a female docking port and a male docking port.

In another aspect thereof, the present invention provides a pilot light system for a gas cook top having a gas supply manifold and one or more burner assemblies receiving gas from the manifold. The pilot light system has a pilot gas tube from the manifold to the burner assembly; and a quick connect gas coupling interconnecting the manifold and the pilot gas tube, including a female docking port and a male docking port.

In a further aspect thereof, the present invention provides a coupling for a pilot light of a gas-fired cooktop having a gas manifold, a burner assembly and a pilot light gas tube connected to the manifold. The coupling is a quick connect gas coupling establishing flow communication between the manifold and the pilot gas tube. The coupling includes a female docking port connected to one of the manifold and the pilot gas tube and a male docking port connected to the other of the manifold and the pilot gas tube.

In still another aspect thereof, the present invention provides a burner assembly for a gas-fired cooktop having a gas manifold. The burner assembly has a venturi; a gas valve controlling gas flow from the manifold to the venturi and a burner head associated with the venturi for combustion of gas. A pilot gas tube is supported by the burner assembly. A quick connect gas coupling establishes flow communication between the manifold and the pilot gas tube. The coupling includes a female docking port connected to one of the manifold and the pilot gas tube and a male docking port connected to the other of the manifold and the pilot gas tube. A pilot burner is at an end of the tube adjacent the burner head.

In a still further aspect thereof, the present invention provides a gas circuit for a gas-fired range having a cooktop and an oven, with a main gas line adapted for connection to a gas supply source, a gas manifold in flow communication with the gas line and a plurality of cook top burner heads. An individual control valve for each burner head establishes flow communication with the manifold. An oven burner and an oven burner gas line are in flow communication with the main gas line. A master shutoff valve interrupts gas flow to the manifold while maintaining gas flow to the oven burner gas line.

Other features and advantages of the invention will become apparent to those skilled in the art upon review of the following detailed description, claims and drawings in which like numerals are used to designate like features.

Figure 1:
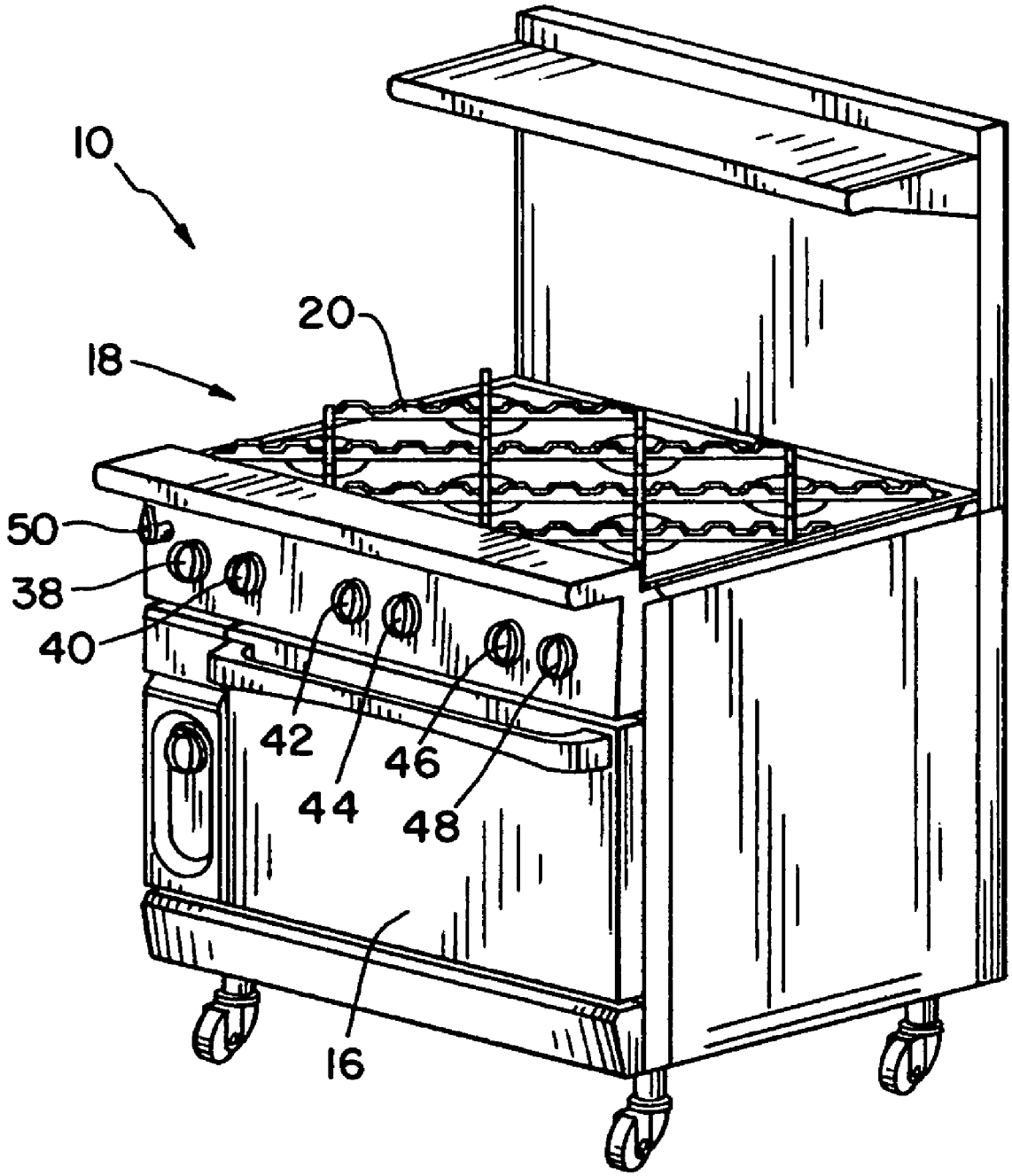
FIG. 1 is a perspective view of a cooking range incorporating the gas circuit and pilot light system of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
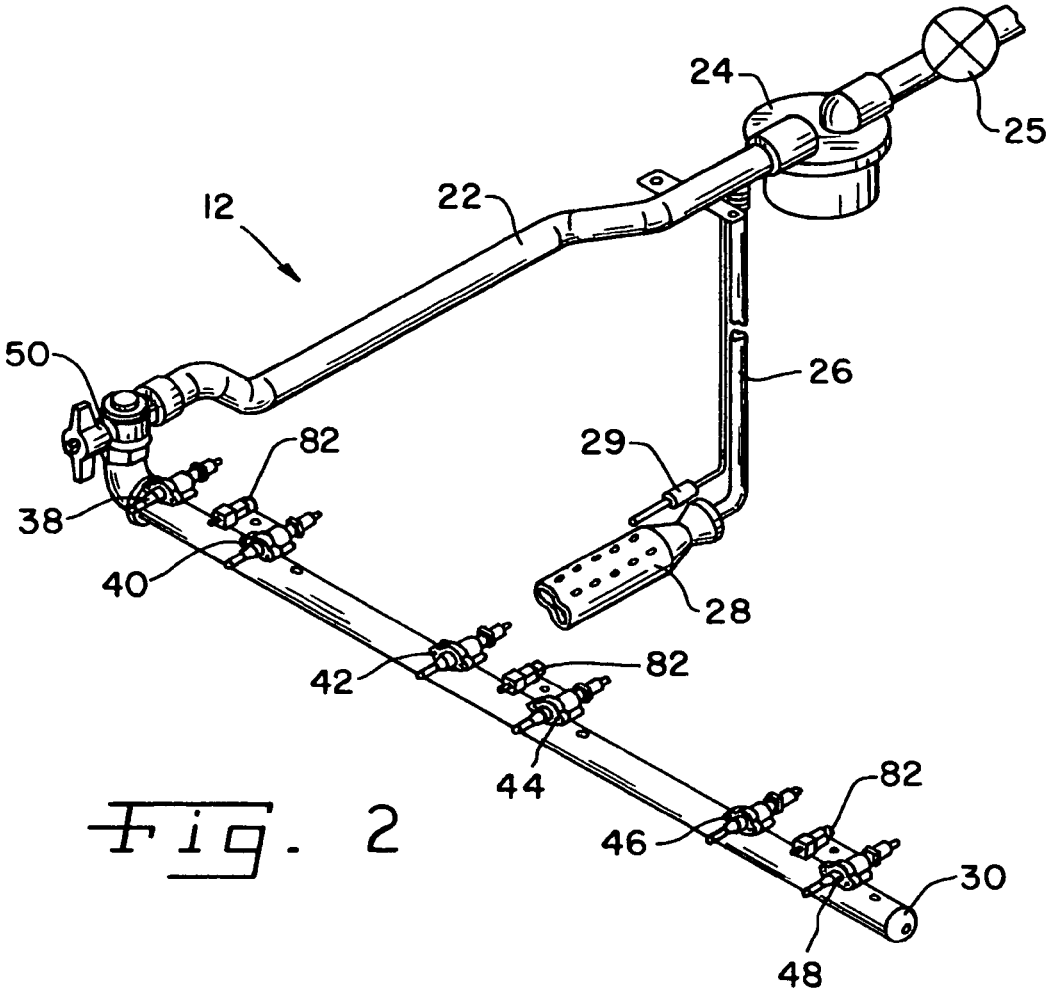
FIG. 2 is a perspective view of a gas circuit in accordance with the present invention.
Figure 4:
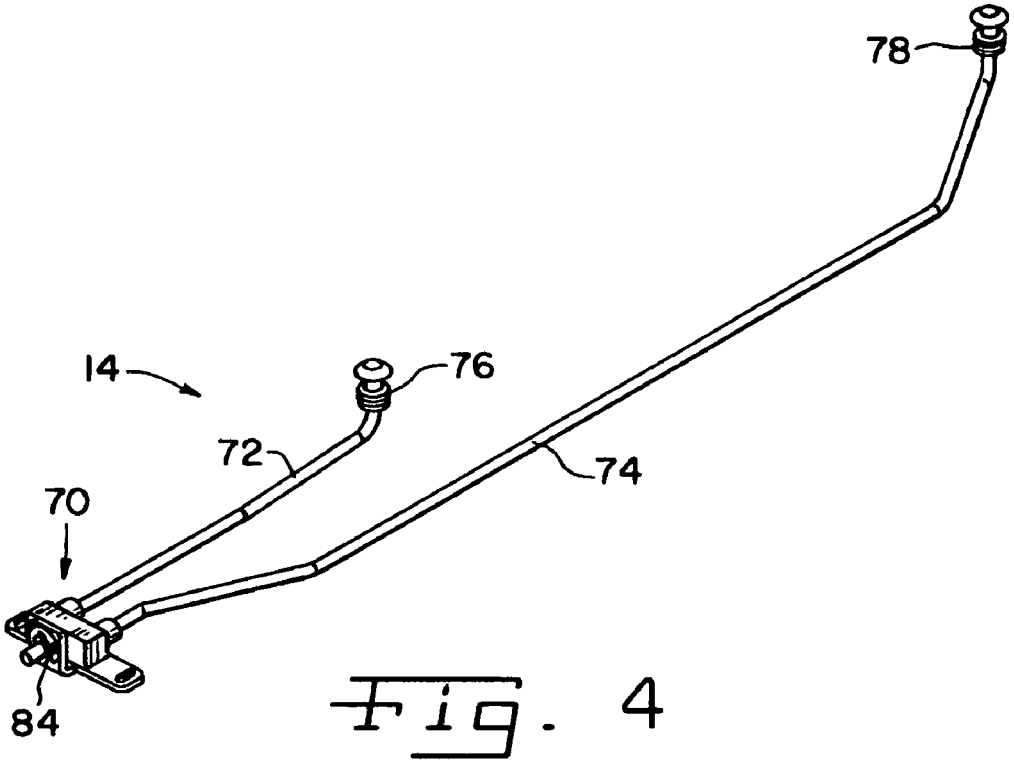
FIG. 4 is a perspective view of a pilot light system in accordance with the present invention.

Referring now more specifically to the drawings and to FIG. 1 in particular, numeral 10 designates a cooking range having a gas circuit 12 (FIG. 2) including a pilot light system 14 (FIG. 4) in accordance with the present invention. The present invention is useful for commercial ranges and residential ranges, and the particular configuration of range 10 shown in FIG. 1 is merely exemplary.

Range 10 further includes an oven 16 and a cook top 18. Cook top 18 has grates 20 for supporting cooking vessels (not show) such as pots, pans, griddles and the like.

Range 10 is a gas fired range, having gas circuit 12 for supplying combustible gas to the various cooking locations on cook top 18, and to heat the interior of oven 16. Circuit 12 includes a main gas line 22 connected to a gas fuel source such as, for example a propane tank (not shown) or a natural gas line from a natural gas utility. In one embodiment, the gas line is connected to the fuel source via a hose (not shown) to allow the range to be moved a short distance for cleaning the kitchen. A pressure regulator 24 in gas line 22 controls the pressure of gas from the source to be distributed throughout range 10. In one embodiment, the regulator is located in a lower, rear, cooler section of the range. A main range shutoff valve 25 can be located shortly upstream of, downstream of or at regulator 24. Main range shutoff valve 25 may be in the form of a quick disconnect associated with the hose (not shown). An oven gas branch line 26 diverts some gas from main gas line 22 to one or more oven burner assembly 28 provided within oven 16. A flow control valve (not shown) is provided for controlling the flow of gas to the one or more oven burner assembly 28, which may also include a pilot light 29.

Main gas line 22 further feeds a gas manifold 30 extending along the front top of the range, from which one or more burner assemblies 32 (FIG. 3) are provided with fuel for burning. In the exemplary embodiment shown in FIG. 1 cook top 18 has six cooking locations, and three burner assemblies 32 are provided, one such burner assembly being illustrated. Each of the three burner assemblies 32 has two burner heads 34, 36, to provide the six cooking locations on cook top 18. Those skilled in the art will understand readily that more or fewer cooking locations can be provided so that cook top 18 may have fewer than six burner heads or may have more than six burner heads.

Each burner head is connected in gas flow communication to manifold 30 via an orifice defined at a control valve 38, 40, 42, 44, 46, 48. Thus, six control valves 38, 40, 42, 44, 46, 48 are shown connected to manifold 30 in flow control relationship. Each control valve is providing for initiating, terminating and controlling the flow rate of combustible gas from manifold 30 to a different one of the burner heads 34, 36 of the three burner assemblies 32. The manner in which control valves 38, 40, 42, 44, 46, 48 are installed and used is well known to those skilled in the art and will not be described in further detail herein.

A gas shut-off valve 50 is provided at the inlet end of manifold 30, upstream of all control valves 38, 40, 42, 44, 46, 48. Shut-off valve 50 can be used to open or close the flow of gas from gas line 22 to manifold 30. Thus, by closing shut-off valve 50, the flow of gas from gas line 22 to manifold 30 can be stopped, without interrupting the flow of gas from gas line 22 to oven branch gas line 26, which is upstream from shutoff valve 50 in main gas line 22.

Figure 3:
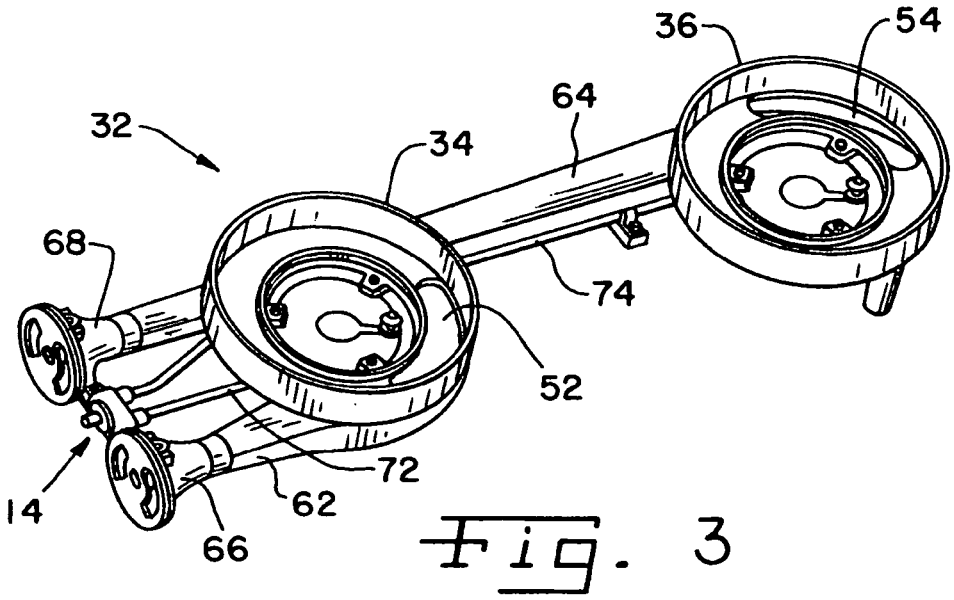
FIG. 3 is a perspective view of a burner assembly embodying the present invention.

Burner assembly 32 illustrated in FIG. 3 is an advantageous structure having two burner heads 34, 36. Thus, only three burner assemblies 32 are required to provide six cooking locations on cook top 18. However, it should be readily understood that separate individual burner assemblies can be provided for each cooking location. Thus, if six cooking locations are provided on cook top 18, six separate burner assemblies can be used, each having only a single burner head associated therewith.

Burner heads 34, 36 are substantially annular bodies defining open top annular channels 52, 54, respectively (FIG. 3). Burner head covers 56, 58 (FIG. 6) are provided on heads 34, 36, respectively. Each cover 56, 58 has a plurality of holes 60 therein through which a mixture of combustible gas and primary combustion air is emitted.

Figure 6:
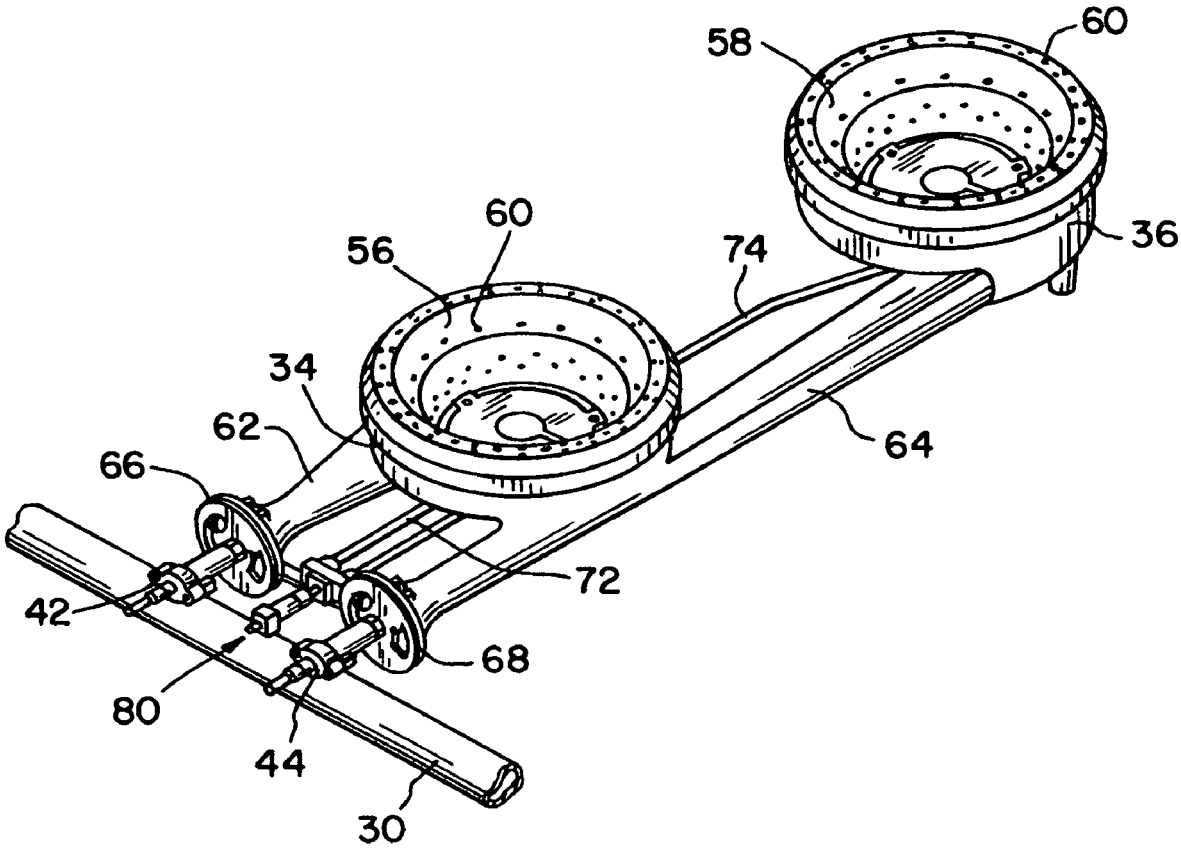
FIG. 6 is a perspective view of a burner assembly with a pilot light system installed on the gas circuit of the present invention.

Burner assembly 32 has a single piece, monolithic casting forming a first venturi 62 and a second venturi 64 together with burner heads 34, 36. First venturi 62 and second venturi 64 provide a flow of gas and primary combustion air for combustion at burner heads 34, 36, respectively, in front and back locations, respectively, on cook top 18. First and second gas receivers 66, 68 are provided on first venturi 62 and second venturi 64, respectively. As known to those skilled in the art, each receiver 66, 68 is aligned with a different control valve 38, 40, 42, 44, 46, 48 to receive gas therefrom when the control valve 38, 40, 42, 44, 46, 48 is opened to allow gas to flow therethrough from manifold 30. Receivers 66, 68 also admit a flow of ambient air to mix with the combustible gas in venturis 62, 64. As illustrated, first venturi 62 and second venturi 64 are configured with burner heads 34, 36 to swirl the combustion mixture in opposite directions with respect to each other. In the embodiment of FIG. 3, first venturi 62 is configured with head 34 to swirl the gas in a counter-clockwise direction, and second venturi 64 is configured with head 36 to swirl the combustion gas in a clockwise direction. It should be understood that the rotational directions within heads 34, 36 can be reversed or can be both in the same direction, either clockwise or counter-clockwise. FIG. 6 illustrates an embodiment in which first venturi 62 is configured with head 34 to swirl the gas in a clockwise direction and second venturi 64 is configured with head 36 to swirl the combustion gas in a counter-clockwise direction.

Each burner head 34, 36 is provided with a small standing flame or pilot light to ignite the gas mixture at burner head 34, 36 when control valves 38, 40, 42, 44, 46, 48 are opened. Thus, one pilot light system 14 is provided for each burner assembly 32. Pilot light system 14 includes a first pilot gas tube 72 and a second pilot gas tube 74 having pilot burners 76, 78, respectively at ends thereof operatively associated with burner heads 34, 36, respectively. Pilot gas tubes 72, 74 are connected in gas flow relationship with manifold 30 through a quick connect coupling 80. Quick connect coupling 80 includes a female docking port 82 included with manifold 30 and a male docking port 84 to which first and second pilot gas tubes 72, 74 are connected. In one embodiment, quick connect coupling 80 has automatic shut-off features such that when male docking port 84 is removed from female docking port 82, gas flow through female docking port 82 is closed. In another embodiment, the quick disconnect does not include an automatic shut off valve, but is merely an easy connection between male docking port 84 and female docking port 82. In the exemplary embodiment, female docking port 82 includes a flow adjustment needle 86 by which the flow rate of gas through quick connect coupling 80 can be controllably adjusted. Adjustable, automatic shut-off pilot valves of the quick connect variety are available from Dormont Manufacturing Co. In yet another embodiment, each pilot tube 72, 74 may have its own quick connect coupling 80 to the manifold 30.

Male docking port 84 is attached between first and second gas receivers 66 and 68, and pilot burners 76, 78 are secured to burner heads 34, 36 such that pilot light system 14 is carried on and supported by burner assembly 32. One or more tabs 88 preferably cast into first venturi 62 and/or second venturi 64 provides support locations for first pilot tube 72 and/or second pilot tube 74. Pilot burners 76, 78 are secured in restrictor plates 90, 92, within the central openings of annular burner heads 34, 36, respectively, to provide flame lighting capacity to the burners.

Figure 5:
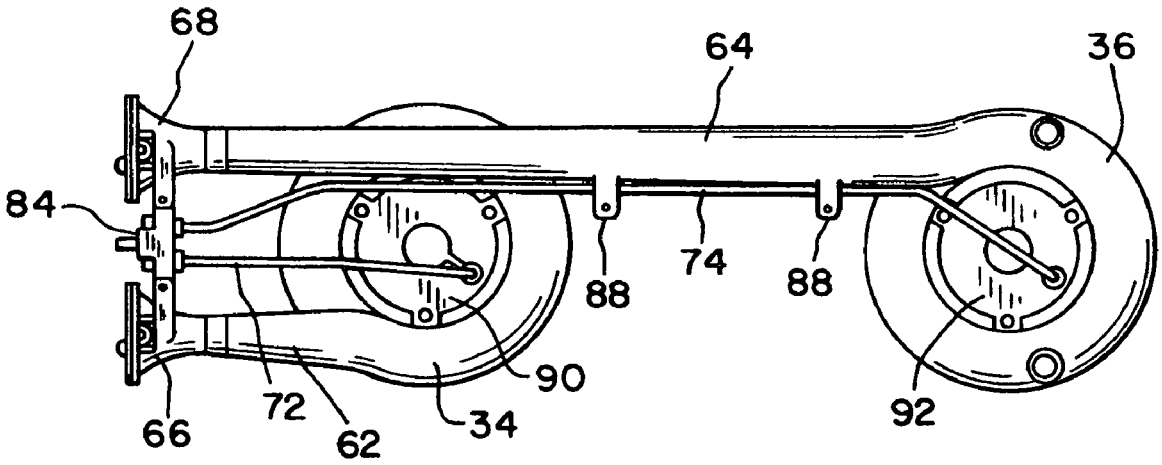
FIG. 5 is a plan view of the bottom of a burner assembly in accordance with the present invention.

As shown in FIGS. 3, 5 and 6, each burner assembly 32 and its associated pilot light system 14 are mutually joined and can be installed in and removed from cook top 18 in unison by merely grasping the assembly and pulling it away from manifold 30. Thus, cleaning around and beneath the burners of cook top 18 is facilitated as compared with known configurations in which pilot light systems are more or less permanently installed in the cook top and only the burner assemblies routinely are removed during cleaning. Disassembly and re-assembly are quicker than with known configurations in which burner assemblies and pilot light systems are separate, requiring separate, individual removal and re-installation.

Shut-off valve 50 can be used to stop all gas flow to manifold 30 if burner assemblies 32 and pilot light system 14 are removed. However, even if shut-off valve 50 is left in an opened condition, individual control valves 38, 40, 42, 44, 46, 48 can be closed to stop gas flow therethrough, and in a preferred embodiment quick connect couplings 80 will close automatically when male docking port 84 is removed from female docking port 82. Thus, even if shut-off valve 50 remains open, gas will not flow from manifold 30 when burner assembly 32 is removed.

Shut-off valve 50 provides improved energy efficiency by providing a conveniently placed valve that allows for the interruption of gas flow to the pilot light system 14 when range 10 will not be used for a period of time. Thus, when a commercial kitchen is closed for the evening, pilot flames at pilot burners 76, 78 can be extinguished without extinguishing a pilot light in oven 16. Pilot lights in ovens are more difficult to access and ignite, and relighting an oven pilot light each on a daily basis can be inconvenient. However, pilot lights at cook top 18 are more readily accessible and more easily ignited. Thus, shut-off valve 50 can be used to reduce the consumption of gas by extinguishing flames at pilot burners 76, 78 when range 10 will not be used for an extended, continuous period of time, such as overnight. When the kitchen is again opened, shut-off valve 50 is opened to restore gas flow to pilot light system 14. Each pilot burner 76, 78 is then ignited and remains ignited while the kitchen is in use. This eliminates one of the drawbacks to pilot flames over electric pilot lighters. With the reliable pilot flame available, chefs will be more prone to turn off the burner between course preparations, which will save additional energy.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A gas supply circuit for a gas cooktop comprising:

a gas manifold configured for connection to a gas supply source;

a burner assembly including a burner head and a venturi positioned to receive gas from said manifold;

a gas valve connected to said manifold for controlling flow of gas from said manifold to said venturi; and a pilot light system including a pilot burner arranged to ignite gas at said burner head, and a pilot gas tube in flow communication with said pilot burner, said pilot burner being affixed to said burner head and said pilot gas tube being carried by and supported on said venturi, said pilot gas tube being connected to said manifold through a quick connect coupling separate from said gas valve, said quick connect coupling including a threadless female docking port and a threadless male docking port, and said burner assembly and said pilot light system being mutually joined to one another for installation and removal from said gas manifold as an assembly upon connecting and disconnecting said male and female docking ports wherein disconnection between said threadless female docking port and threadless male docking port automatically shuts off a gas supply therein.

2. The gas supply circuit of claim 1, wherein said manifold includes said female docking port and said pilot gas tube includes said male docking port.

3. The gas supply circuit of claim 1, said quick connect coupling comprising an adjustable pilot valve.

4. The gas supply circuit of claim 1, said burner assembly having a second venturi and said pilot light system having a second pilot gas tube and second pilot burner associated with said second venturi, and said second pilot gas tube and said second pilot burner being affixed to, carried by and supported on said burner assembly and connected to said manifold through said quick connect coupling.

5. The gas supply circuit of claim 1, said quick connect coupling comprising an automatic shut-off valve closed by separating said male and female docking ports from one another and opened by connecting said male and female docking ports to one another.

6. A burner assembly for a gas-fired cooktop having a gas manifold and a gas valve providing controlled gas flow from the manifold, said burner assembly comprising:

a venturi for receiving gas flow from the gas valve;

a burner head associated with said venturi for combustion of gas;

a pilot gas tube supported by and carried on said burner assembly;

a quick connect gas coupling establishing flow communication between the manifold and said pilot gas tube separate from the gas valve, said coupling including a threadless female docking port connected to one of the manifold and said pilot gas tube and a threadless male docking port connected to the other of the manifold and said pilot gas tube, said male and female docking ports forming an automatic shutoff closing gas flow from the manifold when said male and female docking ports are disconnected one from the other;

a pilot burner at an end of said pilot gas tube adjacent said burner head and arranged to ignite gas at said burner head, said pilot burner being secured to said burner head and said pilot gas tube is supported by and carried on said venturi during removal and reinstallation of said burner assembly; and said venturi, said burner head, said pilot gas tube and said pilot burner being mutually joined for installation and removal from said gas manifold as a single assembly upon connecting and disconnecting said male and female docking ports.

7. The burner assembly of claim 6, said coupling comprising an adjustable pilot valve.

8. The burner assembly of claim 6, said pilot tube being affixed to said venturi.

9. The burner assembly of claim 6, further comprising:

a second venturi connected to said first mentioned venturi, said first venturi and said second venturi being a single monolithic body;

a second burner head associated with said second venturi for combustion of gas flowing through said second venturi;

a second pilot gas tube supported by and carried on said burner assembly;

said second pilot gas tube being connected to said quick connect gas coupling in gas flow communication with said manifold; and a second pilot burner at an end of said second pilot gas tube adjacent said second burner head, said second pilot burner arranged to ignite gas at said second burner head, said second pilot burner being secured to said second burner head to be supported by and carried on said second venturi and said second burner head during removal and reinstallation of said burner assembly;

said second venturi, said the second pilot burner head and said second pilot gas tube being mutually joined for installation and removal as a single assembly upon connecting and disconnecting said male and female docking ports.

10. The burner assembly of claim 9, said coupling comprising an adjustable pilot valve.

11. The burner assembly of claim 9, said first and second pilot tubes being affixed to said first venturi and second venturi, respectively.

* * * * *